US005810233A

United States Patent [19]

Varidel

[11] Patent Number: 5,810,233

[45] Date of Patent: Sep. 22, 1998

[54] DEVICE FOR SEPARATING BLANKS FROM A SHEET OF CUT BLANKS

[75] Inventor: Charly Varidel, Le Mont Sur Lausanne, Switzerland

[73] Assignee: Bobst SA, Lausanne, Switzerland

[21] Appl. No.: 691,534

[22] Filed: Aug. 2, 1996

[30] Foreign Application Priority Data

Aug. 4, 1995 [CH] Switzerland ..... 02 262/95

[51] Int. Cl.[6] ..... B26F 3/02; B65H 35/00

[52] U.S. Cl. ..... 225/97; 225/93; 225/105; 83/152; 493/342; 493/373

[58] Field of Search ..... 83/100, 103, 152; 225/97, 103, 93, 104, 105; 493/342, 363, 373

[56] References Cited

U.S. PATENT DOCUMENTS

| | | | |
|---|---|---|---|
| 3,505,918 | 4/1970 | Schneider | 83/152 X |
| 3,670,612 | 6/1972 | Johnson et al. | 83/99 |
| 4,012,275 | 3/1977 | Sjoholm et al. | 83/100 X |
| 4,065,839 | 1/1978 | Pointer | 83/100 X |
| 4,286,486 | 9/1981 | Franks | 83/100 X |
| 4,302,001 | 11/1981 | Liepert | 83/100 X |
| 4,316,565 | 2/1982 | Hodgkinson et al. | 225/97 X |
| 4,963,126 | 10/1990 | Jesch | 493/342 X |
| 5,292,047 | 3/1994 | Varidel | 225/97 |
| 5,322,202 | 6/1994 | Pelletier | 225/97 |
| 5,341,558 | 8/1994 | Varidel et al. | 225/97 X |
| 5,353,978 | 10/1994 | Varidel et al. | 225/97 |
| 5,382,404 | 1/1995 | Kogame | 83/100 X |
| 5,386,751 | 2/1995 | Dylla et al. | 225/93 X |
| 5,450,333 | 9/1995 | Minami et al. | 83/100 X |
| 5,529,565 | 6/1996 | Oetlinger | 225/105 X |

FOREIGN PATENT DOCUMENTS

| | | | |
|---|---|---|---|
| 2-070 | 1/1987 | Japan | 83/100 |
| 324448 | 11/1957 | Switzerland . | |

*Primary Examiner*—Rinaldi I. Rada
*Assistant Examiner*—Clark F. Dexter
*Attorney, Agent, or Firm*—Hill, Steadman & Simpson

[57] ABSTRACT

A device for removing blanks which have been cut into a sheet of paper or cardboard and are separated from each other by intermediate strips and are surrounded by a crosswise frontal and a crosswise back strip and two lengthwise side strips. The device includes a lower tool having a grid having apertures corresponding to the size and shape of each of the blanks with bars for supporting the intermediate strips, the lengthwise side strips and front and back crosswise strips, and an upper tool having pushing elements of a shape similar to the blank for pushing the blanks through the apertures of the lower tool and also having pressing devices for holding the intermediate and side strips against the respective bars of the lower tool during the step of separating. To prevent the catching of the strips on the lower tool during a subsequent removal of the residual sheet, a portion of the longitudinally extending pressing devices is provided with suction ports to cause a lifting of the portion of the residual sheet as the upper tool is moved upward subsequent to the separation of blanks from the residual sheet and during the step of removing the residual sheet from the device.

7 Claims, 2 Drawing Sheets

DEVICE FOR SEPARATING BLANKS FROM A SHEET OF CUT BLANKS

BACKGROUND OF THE INVENTION

The present invention is directed to equipment for separating blanks for a cutting machine processing flat elements, such as sheets of paper or cardboard.

These cutting machines are, among others, used in order to cut one or several blanks into each sheet, also called formats, which formats, after folding and gluing, may be formed into boxes. Each of the box blanks generally includes the six surfaces of a box and, certain edges being provided with tongues for gluing and closing.

Such a machine usually is formed by a series of stations, with the first station being an input station in which the sheets, preprinted if required, are taken one-by-one from the top of a stack in order to be sent on a feed table, where they are placed in position against frontal and side guides. The sheet can then be grasped at its front edge by a series of grippers fitted along a crossbar, each end of which is attached to a sidewise train chain leading the bar and, thus, the sheet into subsequent processing stations.

The sheet is first conveyed into a cutting station of blanks according to a required size, and these blanks are held to the sheet and/or among themselves merely by some nicks, which are judiciously arranged along the cut edges. The station usually comprises a platen press having an upper immovable platen on which a plate is provided with a plurality of line-shaped straight and curved die-cutting rules or blades. If desired, the cutting station may be preceded by a printing station, which is provided in a platen.

Normally, the sheet is then led to a stripping station where the waste, for example the unused areas of the sheet between the tongues or between the various box blanks, are grasped by upper and lower pins in order to be led downward into a container.

The sheet is then led into a blank separating station, where the fasten points or nicks between the blanks and the sheet are broken by a tool of an upper male planar tool which descends within a lower female planar tool in such a way as to release each of the blanks which falls onto the top of a subjacent stack. Finally, the residual sheet or the remaining portion of the sheet is carried into a delivery station, where it is released by the gripper bar.

On conception of the implantation of the cutting rules on the platen of the cutting station, a distinction is made between a disposition of a "single-cut", where the blanks are concomitant, and a disposition of a "double-cut", where the blanks are separated lengthwise and crosswise one from the other by intermediate cardboard strips, usually of a width of approximately 5 mm. Although generating more waste paper or cardboard, the "double-cut" layout is preferred when the cutting between two blanks has rounded portions or presents difficult cutting lines. It is also desired when the adjacent edges of two blanks are of a different color with a borderline somewhat uncertain.

In the separating station, the sheet is led flatly onto a lower tool in the form of a horizontal board, which has apertures that each have a periphery with a size and shape of the blanks to be ejected. In the case of a double-cut, the lower tool presents consequently the form of a rack or grid, where each lengthwise and crosswise bar reproduces the form of the intermediate cardboard strips separating adjacent blanks one from the other.

The upper tool foreseen to be pulled down sequentially within the lower tool comprises, on the one hand, pushers or punches made of wood or foam, each of which is fastened on the tool above a blank, and the punch has the contour of the border of the blank but of a slightly smaller extent. The upper tool also has pressing devices, i.e., rods or blocks, situated respectively above the intermediate cardboard strips and fitted on elastic supports in such a way to hold each of the strips against its respective bar corresponding to the rack of the lower tool during the blank separating step.

In the case of an imposition of a sheet in "double-cut", the residual sheet after the blank separation has a form of a rack or grid of paper or of cardboard initially supported by each of the bars of the lower tool.

However, shortly after the beginning of the removal of the residual or remaining sheet led by the gripper bar to the output or delivery station, the intermediate strips that extend crosswise to the direction of displacement are supported on their ends and hang down adjacent their middles. When these crosswise strips are relatively long, for example longer than 30 cm, a central deflection may attain 1 cm or 2 cm, which makes these parts subject to becoming caught or snagged on other bars of the rack of the lower tool. Beyond a certain rhythm or rate of removal, the residual sheets have a tendency to tear and to fall down again onto the stack of blanks in an inopportune manner.

SUMMARY OF THE INVENTION

The object of the present invention is to provide an improvement for blank separating equipment which enables the removal of the problem of the breaking of the residual sheet during its removal. The conception of this improvement, however, has to remain simple in order to have a reliable functioning and a low cost. These objects are achieved by providing a device or equipment for separating blanks from a sheet element, which blanks are surrounded with two lengthwise side cardboard strips which are connected to a crosswise frontal strip and a crosswise back strip, and which blanks are separated from each other by intermediate strips. The equipment includes a lower tool in the form of a rack or grid whose bars reproduce perceptibly the border of the blanks and an upper tool comprising pushers, each fastened above a blank from which it assumes, perceptibly, the border slightly smaller than that of the cut blank and pressing means or devices mounted on the tool above the bars by elastic supports in such a way as to hold each intermediate and side strip against their respective bar in correspondence during the blank separating operation, the improvement comprises that at least one part of the pressure device or means situated above the lengthwise and sidewise intermediate strips have one or several exhaust ports attached to a source of partial vacuum, the number of ports and their position, as well as the value of the partial vacuum being such as these pressing devices lift at least a portion of the upstream part of the residual sheet at the raising of the upper tool during the step of removal of the residual sheet.

In other words, the lengthwise pressing means or device is modified in such a manner so that during the raising of the upper tool, between two-thirds and four-fifths of an upstream portion of the residual sheet is lifted with the upper tool. The lower part of the intermediate crosswise strips is then clearly lifted above the crosswise bars of the lower tool. Thus, in a simple and elegant manner, all risk of collision and snagging between the residual sheet and the lower tool grid is eliminated. Moreover, the partial vacuum is adjusted to a value sufficient in order to compensate just the weight of the sheet without creating forces of undue friction to risk provoking a breaking at the gripper bar. Noticeably, the effect of this partial vacuum reduces in proportion as the sheet is being removed by opening, in succession, the ports in order to always exert just a sufficient lifting force.

According to a preferred or best mode, the pressing means or device situated above the intermediate lengthwise strips and the side strips have the form of lengthwise pressure tubes closed on their ends with a length perceptibly identical to those of the tool and whose lower planar surfaces present a series of exhaust ports. The use of tubes as lengthwise pressure devices greatly simplifies the link of the ports to the source of the partial vacuum. Moreover, the lower planar surfaces constitute homogeneous surfaces, against which the lengthwise strips of the residual sheet slide during the removal.

Preferably, a distance a between the downstream end of the pressure tube and the beginning of the series of ports is between one-fourth and one-third of the tube's length. This enables the provision of a slight curve between the lifted sheet and the gripper bar, which is situated slightly above the lower tool.

Advantageously, the series of ports, which are provided in the pressure tubes and are situated above each of the two side strips, is set back or offset toward the center line or median line of the lower surface. Effectively, a contacting of the residual sheet provoked by the lowering of the crosswise strips has been established. This offset of the two series of ports of each side insures that the two side strips are always correctly taken.

According to the best mode, a partial vacuum or suction at a level of the ports is between 500 and 700 millibar. A series of ports comprises a dozen ports of a diameter of about 1 millimeter and a spacing of 5 to 15 centimeters between ports.

Usefully, a reservoir-distributor or manifold in the form of a hollow tube closed on its two ends is arranged crosswise slightly above the lengthwise pressure tubes and is attached, on the one hand, to a vacuum pump and, on the other hand, to each of the pressure tubes by a flexible duct or conduit, which, for instance, forms a loop. This arrangement is relatively simple to build and enables the implantation of the flexible feed ducts in order to compensate for the related movement of the pressure tubes with regard to the upper tool. These ducts provide easy access for both supervision and maintenance.

Other advantages and features of the invention will be readily apparent from the following description of the preferred embodiments, the drawings and claims.

BRIEF DESCRIPTION OF THE DRAWINGS

FIG. 2*b* showing the blanks being separated from the sheet; and FIG. 2*c* showing the removal of the residual sheet.

DESCRIPTION OF THE PREFERRED EMBODIMENTS

In the following description, the terms "upstream" and "downstream" are used in reference to the direction of displacement of the sheet, which is shown by the arrow 100 in FIGS. 1 and 2*c*. Thus, a piece of the upstream side is close to the entrance of the station, whereas a piece of the downstream side is close to the exit. In a similar manner, the expressions "lengthwise/crosswise" and "left/right" have to be understood in relation to the running direction of the arrow 100 for the web or sheet, with the left side usually being the driving side and the right side opposed to the driving side of the machine.

Figure 1:
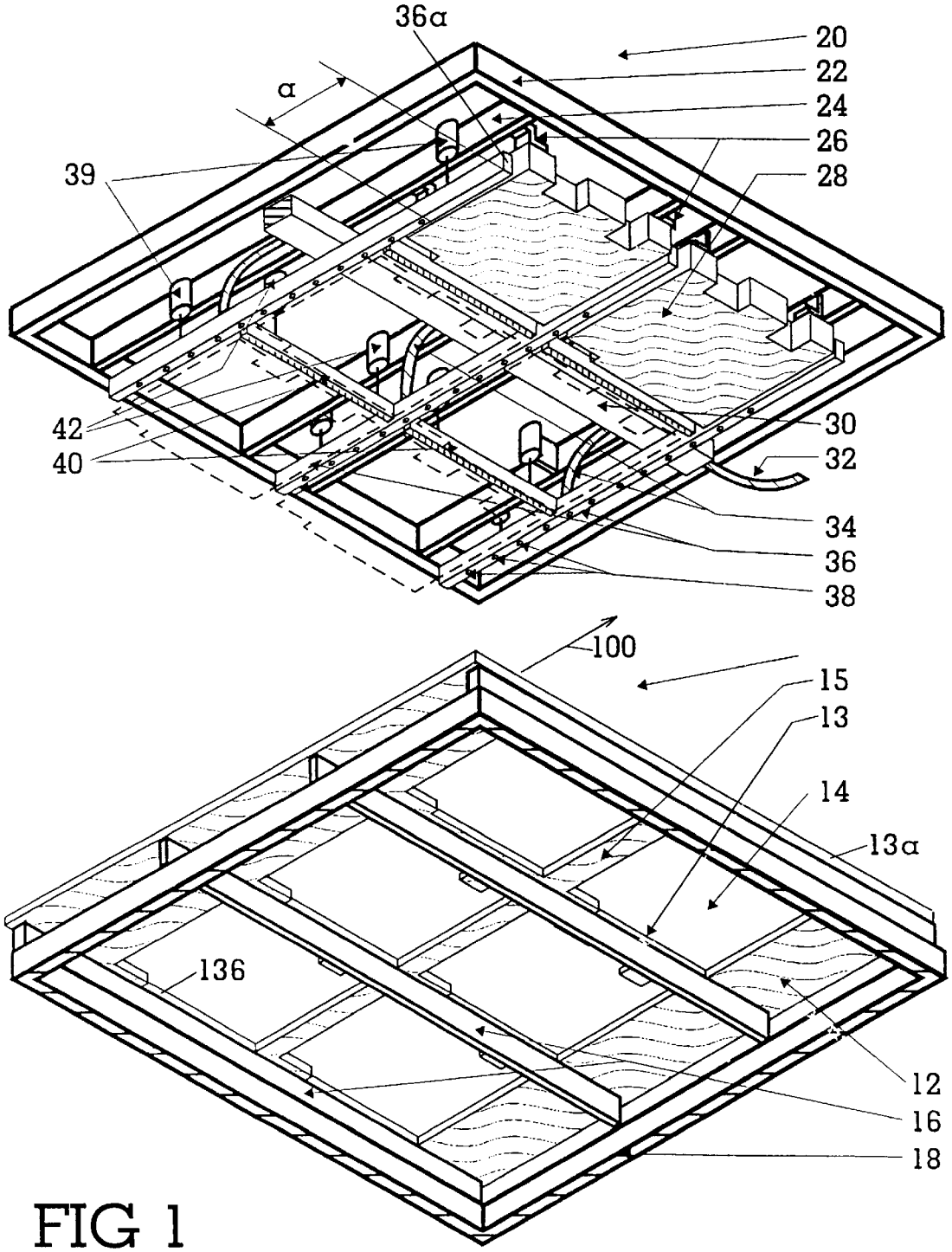
FIG. 1 is a schematic perspective view of two parts of a device or equipment for separating blanks according to the present invention.

The principles of the present invention are particularly useful in a blank separating station having a lower tool, generally indicated at 10, and an upper tool, generally indicated at 20, in FIG. 1. The lower tool 10 is based on a grid-like tool rack 12, which is the shape of a board made of wood and in which has been cut or machined a plurality of apertures 14, with each aperture corresponding to the peripheral outline of the blanks cut into the sheet according to a "double-cut" mode. According to this die-cut sheet, the blanks are surrounded by two side strips which are connected to a back strip and a frontal strip, which frontal strip is held by drive grippers. The blanks are separated between themselves by intermediate lengthwise and sidewise strips of a minimum width of 5 mm. Due to this fact, the tool 12 has, itself, the form of a rack or grid, whose crosswise strips or bars 13 and lengthwise bars 15 perceptibly take the form of the corresponding intermediate strips, but have a width slightly smaller than the strips.

In the illustrated example, the tool 12 is held by a plurality of crossbar supports 16 located under the frontal bar 13*a*, the back bar 13*b* and each of the crossbars 13. These crossbar supports 16 rest on a removable lower frame 18. Alternatively, the crossbar supports 16 can be an integral part of the frame 18.

Usefully, this frame and these crossbars are made of formed metallic bars, preferably of aluminum, due to its relative lightness. The fact that these bars are shaped so as to be higher than they are wide ensures a great rigidity in the vertical direction of the tool 10. The external surfaces of the upstream and downstream crossbars of the frame are provided with grooves (not shown) that enable the tool to be removed and then reinstalled in the station by passing the tool through a lateral window and sliding it along two upstream and downstream gibs or guides belonging to the fixing mechanism of the station. The frame is moreover provided in its four comers with centering blocks (not shown) that have conical parts and that receive locking tenons. Like this, the lower tool can be removed comfortably to change the configuration of the tool 12 according to the new cut patterns for the blanks of the following production series.

The upper tool 20 has a rectangular frame 22 made rigid by longitudinal bars 24. The frame 22, which includes the bars 24, has a cross section particularly rigid in the vertical direction.

A plurality of pushers 28 are fastened to the frame of the upper tool 20, and this in a rigid manner by means of lug link plates or members 26. Each pusher 28 is in a vertical position corresponding with an opening 14 of the lower tool 12. These pushers 28 have the form of wood boards or rigid elastomer blocks, possibly chambered in their middles, but whose border assumes the border of one of the blanks cut into the sheet so that the border of the pusher 28 is in correspondence with the opening 14.

Lengthwise pressing means, tubes or devices 36 and crosswise pressing means, tubes or devices 40 are installed between the pushers 28. The lengthwise pressing means 36 are attached to the longitudinal bars 24 of the frame 22 by a pair of elastic telescopic supports 39, with one on the upstream part and one on the downstream part. Such a support 39 can be a rod, whose lower end is fastened to the pressing means 36 and whose upper end slides in a flap or tab (not shown) attached to the crossbar 24. A spring (not shown) is coaxially mounted on the rod and acts between the pressing means 36 and the flap or tab in such a way as to be compressed when the pressing device approaches its longitudinal bar. The length of the rod is selected so that the lower surface of the pressing device 36 is situated slightly beneath the lower surface of the pushers 28 by an amount of 5 mm to 10 mm. The crosswise pressing means 40 are fitted in a similar manner on the longitudinal bars 24 by elastic telescopic supports 42. The pressing means 36 and 40 are introduced between the pushers 28 so that they are in vertical correspondence respectively with the bars 15 and 13 of the tool rack 12.

More particularly, according to the invention, the lengthwise pressing means 36 have a series of exhaust ports 38. To realize this, each of the pressing means 36 is a rectangular section of tubing which is closed at each end. The interior of each of these tubes is attached by a flexible duct 34 to a distributor reservoir or manifold 30, which is attached to a vacuum pump (not shown) by a feed duct or conduit 32. This distributor reservoir or manifold 30 has the shape of a closed hollow tube with both ends being closed and is arranged to extend crosswise to the lengthwise pressing means 36 and is positioned between the pushers 28 and the longitudinal bars 24. Ducts 34 connecting the distributor reservoir or manifold 30 to the pressing means 36 are made of flexible material and can even take the form of a loop so as to be easily deformed during the movement of the lengthwise pressing means 36 with regard to the longitudinal bars 24.

In the illustrated best mode, each lengthwise pressing means 36 presents a same series of a dozen exhaust ports 38, each port having a diameter of about 1 mm and having a spacing between the ports in a range of 5 cm to 15 cm. The partial vacuum in the distributor reservoir or manifold 30 is such that, in taking into consideration the loss of some vacuum in the flexible ducts 34, a partial vacuum of about 500 millibars to 700 millibars is provided at the point of each of the exhaust ports.

Notably, the series of exhaust ports 38 begin at a point which is spaced a distance a of about one-third or one-fourth of the total length of the pressing means 36 from the downstream end 36*a* of each of the pressing devices 36.

Figure 2A:
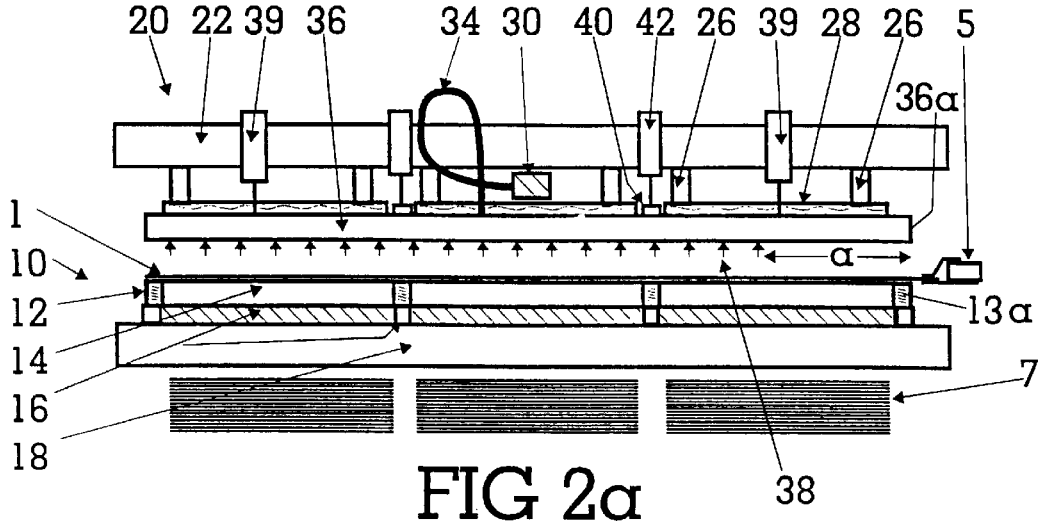
FIGS. 2*a*, 2*b* and 2*c* are schematic side views with portions removed for purposes of illustration of the equipment, with FIG. 2*a* showing the arrangement of the equipment on the arrival of a sheet having blanks to be separated.
Figure 2B:
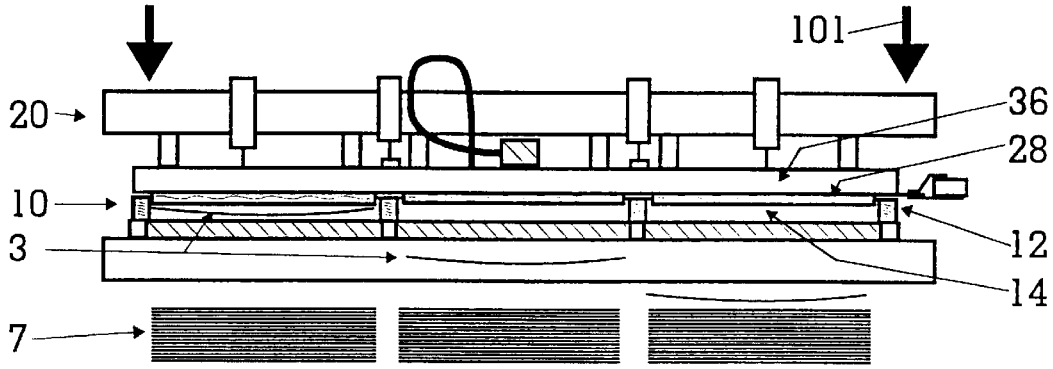
Figure 2C:
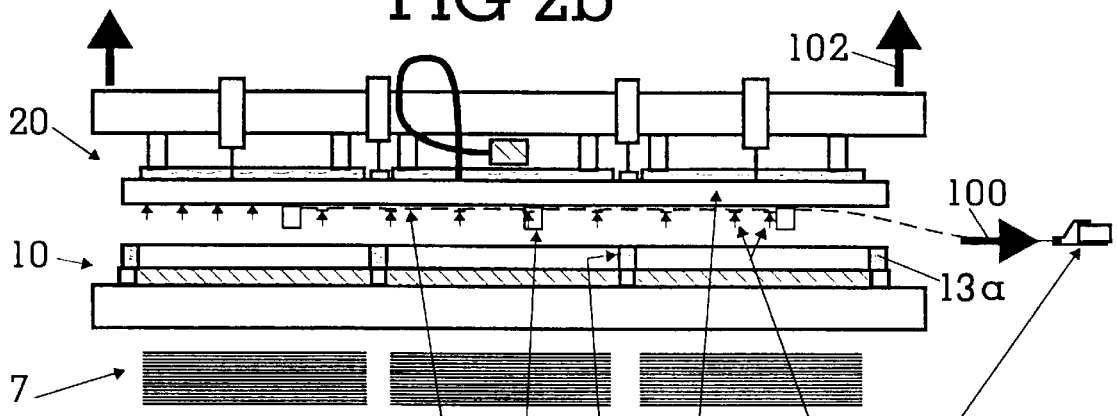

The functioning of the equipment for separating blanks according to the present invention is better grasped from a study of FIGS. 2*a*–2*c*, in which the same numerical references have been utilized.

In FIG. 2*a*, the upper tool 20 has been raised and a gripper bar 5 leads a sheet 1 on the top of the fixed lower tool 10, which is the top of the tool rack 12. The functioning of the exhaust of the lengthwise pressing means 36 has no effect at this particular time.

As illustrated in FIG. 2*b*, the upper tool 20 has been lowered in the direction of arrow 101 within the lower tool 10 until the pushers 28 have penetrated into the apertures 14. Just before the penetration of these pushers 28, the lengthwise pressing tubes 36 and the crosswise pressing tubes 40 have pressed the intermediate strips against the corresponding bars or portions of the tool 12. The penetration of the pushers into the aperture 14 will cause the immediate breaking of the nicks attaching each blank to the sheet. This breaking is accomplished with an ejection of the blanks 3 downward, so that they will fall squarely on the top of their respective stack 7.

After completion of the downward strokes illustrated in FIG. 2*b*, the upper tool 20 is raised, as indicated by the arrow 102, and the gripper bar 5 will move in the direction of arrow 100 to withdraw the residual sheet 1' to the output station. More particularly, according to the invention, the presence of a suction at the exhaust ports 38 makes the atmospheric pressure hold the portions of the residual sheet 1' against the lengthwise pressing means 36 so that the sheet is carried upward with the upper tool 20. As can be seen, the intermediate crosswise strips 2 in suspension are then clearly above the crosswise bars 13 so that they will not interfere therewith. At the removal, the residual sheet 1' slides along the raised lengthwise pressing means 36, with the upstream ports being opened again as the sheet advances, which opening automatically adjusts the effect of the atmospheric pressure on the downstream part of this residual sheet.

As will be understood, the absence of exhaust ports in the downstream part of the lengthwise pressure means 36 enables the sheet to describe a shallow curve to the gripper bar 5, which is situated at a lower level, which is practically at the level of the upper surface of the tool 10.

Owing to this improvement, the removal of the residual sheet 1' occurs in a reliable manner, even at high rates of operation. The modification has essentially consisted of a provisions of a series of ports in elements already present, and the provision of a simple distributor reservoir buffer or manifold 30 and a canalization of flexible ducts 34 of the correct dimensions. Therefore, the cost of this improvement is low and its maintenance presents no particular problems.

Although various minor modifications may be suggested by those versed in the art, it should be understood that I wish to embody within the scope of the patent granted hereon all such modifications as reasonably and properly come within the scope of my contribution to the art.

I claim:

1. In a device for separating blanks which were cut into a sheet of material selected from a group consisting of paper and cardboard, said sheet having a frontal strip connecting two lengthwise side strips with the blanks disposed therebetween, said blanks being separated from each other by lengthwise and transverse intermediate strips, said intermediate strips, side strips and frontal strips forming a residual sheet once the blanks are removed therefrom, said device comprising a lower tool in the shape of a grid having lengthwise bars and crosswise bars disposed in a pattern to form apertures in the location, shape and size of the blanks, an upper tool being mounted for movement relative to the lower tool with a plurality of pushers having a contour slightly smaller than that of the apertures for pushing the blanks into the apertures of the lower tool, as the upper tool moves toward the lower tool and pressing means positioned between the pushers for holding the lengthwise side strips and the intermediate strips against the respective bars of the grid as the pushers force the blanks through the apertures, the improvement comprising at least part of the pressing means located above the lengthwise bars having exhaust ports connected to a source of partial vacuum so that as the upper tool is being lifted upward, at least an upstream part of the residual sheet is raised with the upper tool away from the lower tool to enable removing the residual sheet from the device.

2. In a device according to claim 1, wherein the pressing means above the lengthwise bars are formed by elongated tubes closed at each end, the length of each tube being substantially identical to the length of the upper tool, and each tube having a lower planar surface which has a series of the exhaust ports.

3. In a device according to claim 2, wherein each of the elongated tubes of the pressing means has a portion free of exhaust ports located at a downstream end, said portion free of exhaust ports having a length in a range of one-fourth to one-third of the length of the tube.

4. In a device according to claim 3, which includes a manifold in the form of a hollow tube closed on both ends, said hollow tube being arranged above the elongated tubes, said hollow tube being connected to the source of partial vacuum, and being connected to each of the elongated tubes by a flexible duct.

5. In a device according to claim 2, wherein each series of exhaust ports includes a dozen ports having a diameter of 1 mm and a spacing from one another in a range of 5 cm to 15 cm, and the partial vacuum is in a range of between 500 millibars and 700 millibars.

6. In a device according to claim 5, which includes manifold in the form of a hollow tube closed at two ends and being arranged above the elongated tubes, said hollow tube being connected to the source of partial vacuum by a flexible duct, and being connected to each of the elongated tubes by an additional flexible duct.

7. In a device according to claim 2, which includes a manifold in the form of a hollow tube closed at each end and being arranged above the elongated tubes, said hollow tube being connected by a flexible conduit to the source of partial vacuum, said hollow tube of the reservoir distributor being connected to each of the elongated tubes by an additional flexible duct.

* * * * *